US006348677B2

(12) United States Patent
Aurre et al.

(10) Patent No.: US 6,348,677 B2
(45) Date of Patent: Feb. 19, 2002

(54) SENSOR CIRCUIT FOR DETECTING THE PRESENCE OF A PAN ON AN ELECTRIC COOKER HOB

(75) Inventors: Ismael Arbe Aurre, C. Urbitarte; Jose M. Mitxelena Alzuri, C. Sagastialdeberri, both of (ES)

(73) Assignee: Eika, S. Coop, Etxebarria (ES)

( * ) Notice: Subject to any disclaimer, the term of this patent is extended or adjusted under 35 U.S.C. 154(b) by 0 days.

(21) Appl. No.: 09/798,839

(22) Filed: Mar. 1, 2001

(30) Foreign Application Priority Data

Mar. 24, 2000 (ES) ..... 200000717
Nov. 24, 2000 (ES) ..... 200002818

(51) Int. Cl.[7] ..... H05B 1/02

(52) U.S. Cl. ..... 219/518; 219/501; 219/494; 219/448.11; 219/704; 340/870.31

(58) Field of Search ..... 219/518, 704, 219/501, 497, 494, 448.11, 460.1; 340/825.16, 568, 870.2, 870.31

(56) References Cited

U.S. PATENT DOCUMENTS 4,013,859 A * 3/1977 Peters, Jr. ..... 219/10.77
5,900,175 A * 5/1999 Kicherer et al. ..... 219/463
6,075,463 A * 6/2000 Wauer ..... 340/870.17

* cited by examiner

*Primary Examiner*—Mark Paschall
(74) *Attorney, Agent, or Firm*—The Kline Law Firm

(57) ABSTRACT

On an electric cooker the sensor circuit (1) detects the presence of a pan (2) on each heater (F1–F4) and comprises a microcontroller (4) and a generator (6,7) that supply a high-frequency current (Ig) to a respective sensor loop (E1–E4) of each heater which generates a magnetic field, and two maximum and minimum reference signals (Vr0, Vr1) for all the heaters (F1–F4) obtained in the working temperature condition and a circuit (9–13) for measuring and evaluating the voltage (Vs) produced in each sensor loop, with a circuit part (11,11') for demodulation into low frequency of the measuring and reference signals (Vs,Vr0, Vr1), and their differential amplification (Vm,Vrr).

7 Claims, 4 Drawing Sheets

SENSOR CIRCUIT FOR DETECTING THE PRESENCE OF A PAN ON AN ELECTRIC COOKER HOB

TECHNICAL FIELD OF THE INVENTION

The present invention relates to a glass ceramic electric cooker hob with various heaters and with detection of a metal object by means of the generation of a high-frequency magnetic field within an inductive ring of each heater and an electronic circuit for measuring and evaluating the resultant voltage signals.

PRIOR ART

Monitoring the power of a glass ceramic electric cooker hob permits better distribution of the power among the various cooker heaters and a saving of the energy consumed when the power control is either activated automatically, depending on the presence of the pan, or else the power is regulated in accordance with the heater area covered by the pan.

Devices are known for detecting the presence of a pan on a glass ceramic cooker hob, comprising means for generating an electric field in a conductor loop, situated below the glass ceramic hot plate and covering the heating resistors, and an electronic circuit for evaluating the variation in the voltage at the ends of the loop as a result of the presence of a metal pan and for switching the heater power control on or off, depending on the proximity and size of the pan on the heated area.

Sensor circuit are also known for detecting a pan on a glass ceramic cooker hob, with a sensor loop extended below the area of a heater, comprising a circuit for conditioning the voltage signal obtained from the ends of a sensor loop and a reference signal generator circuit, which has predetermined value in both extreme conditions of the sensor loop, namely in the absence of a pan and with a pan covering the heated area entirely.

DISCLOSURE OF THE INVENTION

The object of the present invention is an electronic circuit with an inductive type sensor for detecting a metal pan on the heated area of an electric cooker hob, as defined in claim 1.

The invention overcomes the problems of improving the simplicity, economy and precision of the detector circuit and sensor, since the latter comprises a single conductor loop of simple layout superimposed on each hob heater, a magnetic field for detection is generated by the actual sensor loop, and a high-frequency electric current for generating the magnetic field comes from a microcontroller which extracts pulse trains from the generator circuit to prevent electromagnetic disturbances in the supply network. The proximity of the metal pan is measured through the variation in voltage at the ends of the loop, unaffected by the length of the connection cables, and it is due to the induced eddy currents in the pan, which cause a reduction in the inductance of the sensor loop.

The sensor comprises a single conductor loop of simple layout, superimposed on each cooker hob heater, the magnetic field being generated under the pan, which is affected by the area of the loop covered by the pan since the sensor circuit is located below the cooker hob control panel, the differences in humidity and ambient temperature, the latter ranging from 0° C. to 125° C., lead to deviations in the result of the measurement on different measuring occasions.

An objective sought by the invention is measurement with low frequency signals in order to simplify the parts of the sensor measuring circuit. In a first sensor circuit embodiment the voltage signal obtained from the measurement is amplified and then demodulated to extract its envelope, prior to its evaluation. In a second sensor circuit embodiment, its subsequent differential amplification is achieved at low frequency, high input voltage values being obtained at the microcontroller for their comparison.

An additional objective sought by the invention is to prevent not only the influence of the actual impedance of the sensor on the result of the measurement, thereby increasing the sensitivity of the sensor circuit, which is affected by the length of the sensor loop supply cables, but also the influence of the ambient temperature of the sensor circuit. The ambient temperature close to the sensor circuit, since this is located below the cooker hob control panel, may vary from 0° to 125° C. on different occasions of measurement.

In the first embodiment according to the present invention, the measurement evaluating circuit has a circuit part built-in so as to offset the deviations in the measurement that are usually produced by differences in humidity and ambient temperature. The measuring voltage is taken between both ends of the sensor loop, unaffected by the supply cables.

In the second embodiment according to the present invention is used at least one reference signal generated in normal temperature and humidity conditions in the sensor circuit during detection by way of an additional inductive circuit, which has an impedance representative of all the heaters. It thereby achieves not only an improvement in the sensitivity and resolution of the electrical measurement representative of pan detection, but also the simplification of the cooker electrical wiring, as it uses a single supply cable for generating the magnetic field in the sensor loop and for its measurement, the measuring voltage signal being taken from the free end of the single cable.

A numerical value representative of each heater is recorded at the microcontroller for comparison with a numerical value obtained from measurement. The limit numerical value for the actuation of heating power is pre-set by means of a test with a pan of appropriate size for the area of the heater detected. The numerical value of the measurement of each heater is obtained by means of a calculation that relates the voltage signal measured to the at least one reference signal transmitted.

DETAILED DESCRIPTION OF THE PREFERRED EMBODIMENTS

Figure 1:
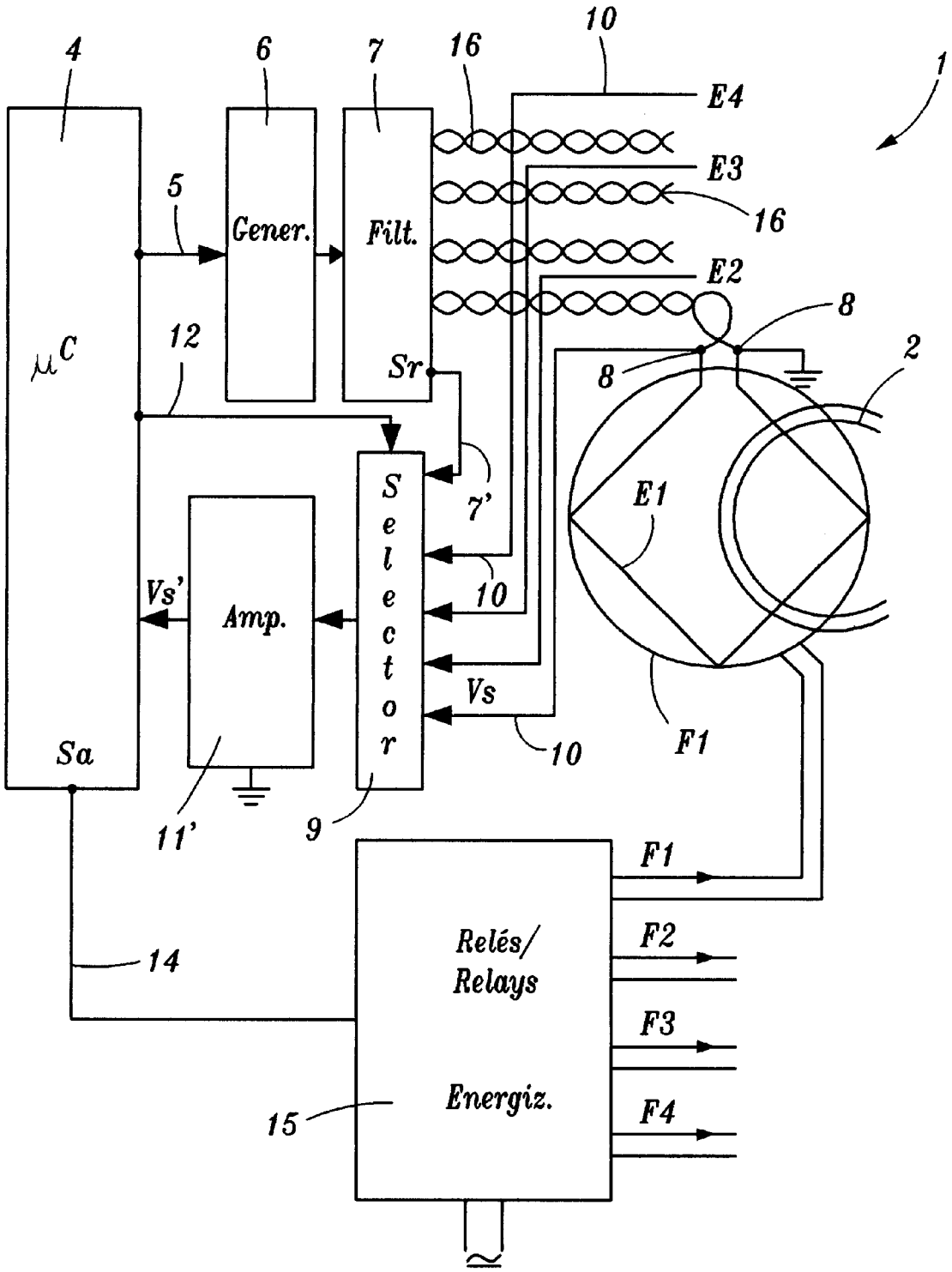
FIG. 1 is a wiring diagram of an initial embodiment of a sensor circuit for detecting a pan on a glass ceramic cooker hob, according to the invention.

With reference to FIGS. 1, 3, 4, 6, a first embodiment of the sensor circuit 1 is represented in FIG. 1, for the detection of a metal pan 2 on each of the four heaters F1–F4 of a glass ceramic electric cooker, comprising a microprocessor 4 for monitoring the circuit that supplies rectangular pulse trains 5 (in FIG. 3) with a period of 1/Fp and a preferred frequency of 1–10 MHz, a generator 6, 7 with a sinusoidal current Ig of the same frequency, a round or quadrangular-shaped conductor loop E1–E4 superimposed on each heater F1–F4, provided with two loop ends 8 that receive the current Ig, generating a magnetic field that passes through the glass ceramic hob to the pan 2, a circuit 7, 7', 9 for correcting the result of the measurement in accordance with the ambient temperature Ta of the circuit 1, in cooperation with the microprocessor 4 and an actuating circuit part 14, 15 for energizing each of the heaters.

A specimen pan 2 for detection has a diameter D=200 mm, and the sensor loop E1–E4 of its appropriate heater F1–F4 is quadrangular with 135 mm sides.

The circuit 4,6,7 generating the current Ig includes an amplifier 6 and a harmonics filter 7, and the current Ig, with an amplitude for instance of 5 mA, is conducted to each sensor loop E1–E4 by way of a resistor in series with it, of a high value in respect of the impedance of the sensor loop E1–E4, and a pair of braided cables 16.

Evaluation circuit 4, 9–12 comprises a selector 9 that selects one of the heaters F1–F7 in a multiplexing sequence governed by a line 12 coming from the microprocessor 4, and it has a line 10 connected for transmitting the voltage signal Vs (in FIG. 4*a*) present between both ends 8 of each one of the sensor loops E1–E4, which excludes impedance of supply cables 16, for carrying out detection of the pan 2, an amplifier 11' of the peak values of the voltage Vs transmitted from each sensor loop E1–E4. The amplified voltage is conducted to the microprocessor 4, wherein it is demodulated in order to obtain its envelope Vsa (FIG. 4*b*), the value of which is compared directly with a reference value Vr (in FIG. 6) recorded in the microprocessor 4 corresponding to each sensor loop E1–E4, and predetermined in the total absence of pan 2 condition.

A measurement (FIG. 6) made with the pan 2 and the sensor loop E1–E4 of the above-mentioned example, gives a relative value of Vsa/Vr=⅔, corresponding to detection when the area of the heater F1–F4 covered by the pan is total, whereas minimum sensitivity corresponds to a 40% coverage of this area by the pan 2, which has to be exceeded so as to obtain a noticeable variation in the Vsa/Vr coefficient.

The part 7,7',9 of circuit for correcting the measurement relative to ambient temperature obtains from an output Sr of the current generator filter 7 a reference signal 7' which is received by the evaluation circuit selector 9 for self-calibration by the microprocessor 4, in a sequence with the voltage measuring signals Vs transmitted from each sensor loop E1–E4.

The actuating circuit part 14, 15 is connected to an output Sa from the microcontroller 4, by way of a switching signal transmission line 14, and a respective relay for energizing the heaters F1–F4 when the presence of the pan is detected covering, for instance, half the area of the heater.

Figure 2:
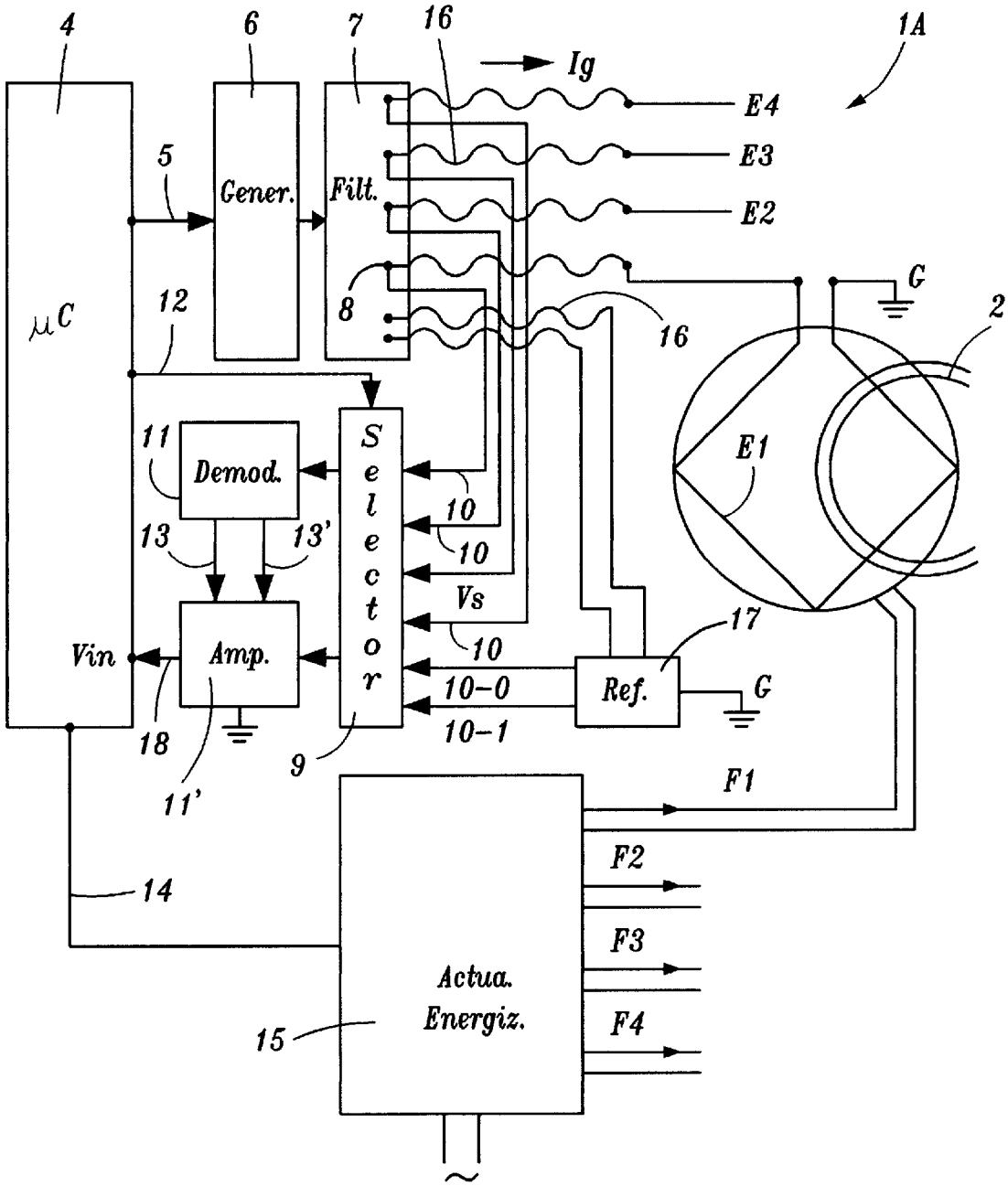
FIG. 2 is a wiring diagram of a second embodiment of a sensor circuit for detecting a pan on a glass ceramic cooker hob, according to the invention.
Figure 3:
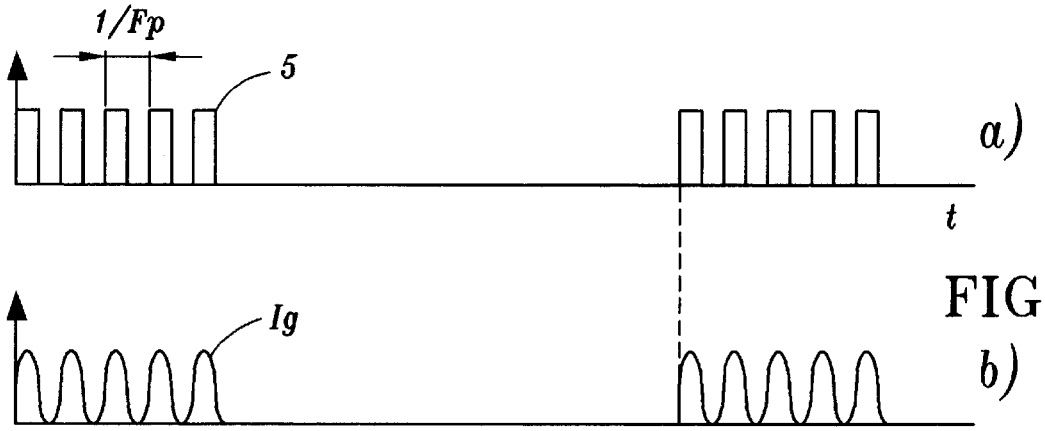
FIG. 3*a*) is a graphic representation of the high-frequency electrical pulse generated by the sensor circuit of FIG. 1.
FIG. 3*b*) is a diagram of the electrical current through each sensor loop of sensor circuit in FIG. 1.
Figure 4:
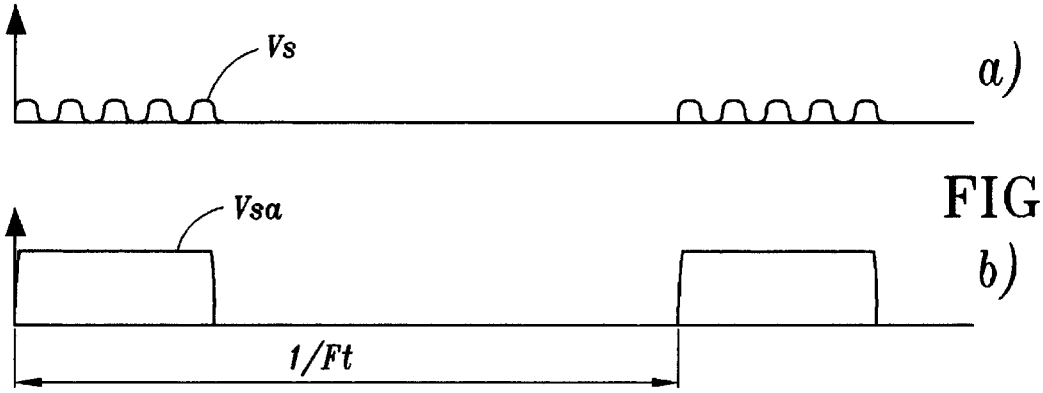
FIG. 4*a*) and FIG. 4*b*) show two diagrams of the electrical signal obtained for measurement in the circuit in FIG. 1, amplified and demodulated, respectively.
Figure 5:
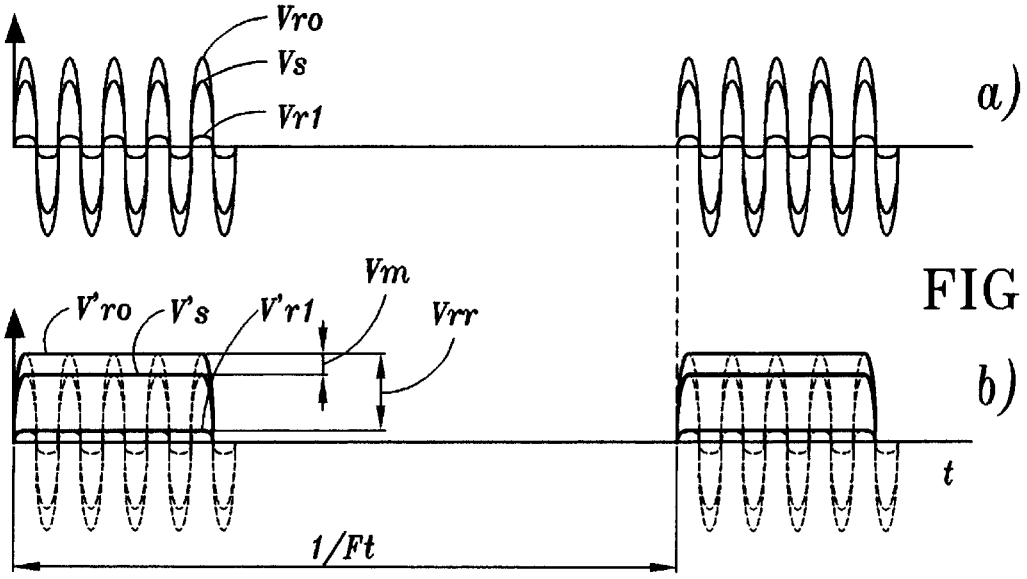
FIG. 5*a*) and FIG. 5*b*) show two diagrams of the voltage signals obtained for measurement in the circuit in FIG. 2, of high and low frequency, respectively.
Figure 6:
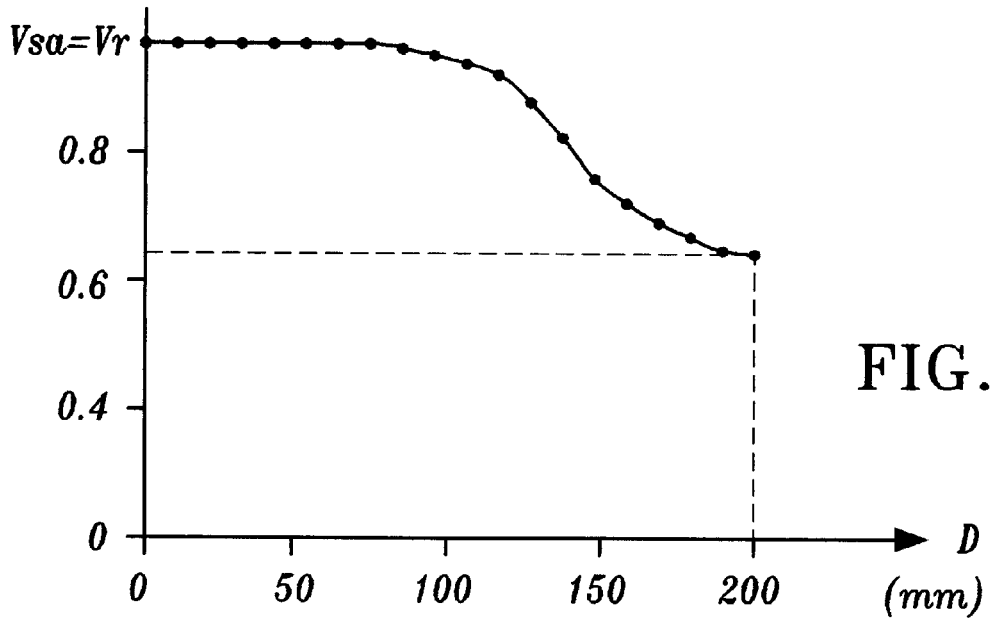
FIG. 6 is a diagram showing the result of the measurement carried out by the sensor circuit of FIG. 1, in accordance with the diameter of the pan.
Figure 7:
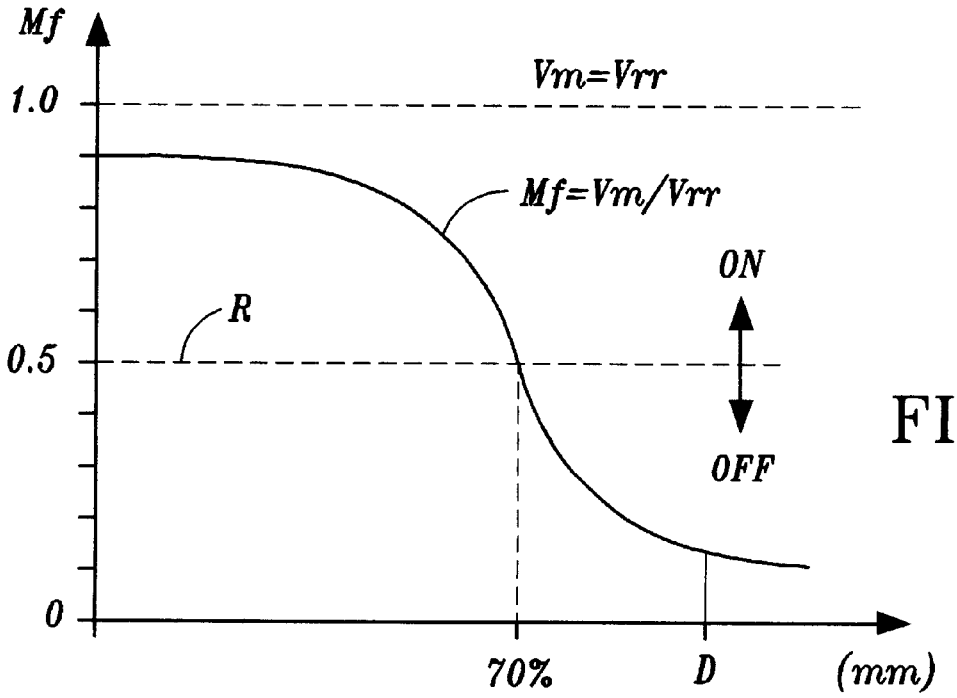
FIG. 7 is a graphic illustration of the relative end result of the measurement evaluation, obtained in the sensor circuit of FIG. 1.

With reference to FIGS. 2,3,5,7 a second embodiment of sensor circuit 1A is represented in FIG. 2, for the detection of a pan 2, comprising a microcontroller 4, which governs the circuit 1 and supplies rectangular pulse trains 5 (FIG. 3*a*) with a period of 1/Fp and a frequency of 1–10 Mhz, a generator 6,7 of a sinusoidal current Ig of the same frequency (FIG. 5*b*), a round or quadrangular-shaped conductor loop E1–E4, superimposed on each heater F1–F4, which conducts the current Ig generating a magnetic field that traverses the glass ceramic hob towards the pan 2, a circuit 4, 9–13' for evaluating, in cooperation with the microcontroller 4, the measurement of the voltage signal Vs obtained (FIG. 5*a*) from each sensor loop E1–E4 including its single supply cable 16, and a sensor actuating circuit 14, 15 for energizing each one of the heaters F1–F4, in accordance with the result Vm of the evaluation and of its comparison (FIG. 5*b* and FIG. 7) of the measurement.

The circuit 4,6,7 generating the current Ig, of an amplitude for instance of 5 mA, includes an amplifier 6 and a harmonics filter 7, from which it is conducted to each sensor loop E1–E4 as well as to an additional reference inductive circuit 17. Each sensor loop E1–E4 and the reference inductive circuit 17 are supplied through an individual resistor (not shown in the drawings), of a high value in respect of the impedance of the sensor loop E1–E4.

Each sensor loop E1–E4 has two loop ends, one of which is connected directly without a conductor cable to the circuit ground "G", while the other end conducts the current Ig over a single supply cable 16, connected to the generator 6,7 at a point 8 for picking up the voltage signal Vs for the measurement, which is transmitted over line 10 of each heater F1–F4 to the evaluation circuit 9–3. At the same time, in cooperation with the generator circuit 6,7, the microcontroller transmits over a reference inductive circuit 17 a minimum reference signal Vr1 and a maximum reference signal Vr0 (FIG. 5*a*), established as common signals for all the heaters F1–F4, in a normal working ambient temperature condition of approximately 105° C. and in extreme conditions of coverage of the heaters F1–F4: absence of pan—maximum impedance —and total coverage—minimum impedance.

The evaluating circuit 4,9–13' comprises a heater F1–F4 selector circuit 9, a demodulator circuit 11 for the three voltage signals Vs, Vr0 and Vr1 (FIG. 5*a*) and an amplifier circuit 11' for the respective converted signals Vs', Vr0' and Vr1 (FIG. 5*b*) from the demodulator 11. The measurement evaluation process followed (FIG. 5*b* and FIG. 7) is as follows: by way of each sensor loop E1–E4 pick-up line 10, selector 9 switches the measurement Vs of each heater F1–F4 successively in a sequence governed by a line 12 from the microcontroller 4. In the same sequence, besides the lines 10, two lines 10-0 and 10-1 for transmitting reference signals Vr0 and Vr1 respectively are switched as well. The demodulator circuit 11 receives sequentially from selector 9 a pulse train of each signal Vs (1–4), Vr, Vo, of high frequency and a 1/Fp period (FIG. 2*a*), and converts them into the respective low frequency signals Vs', Vr0' and Vr1' (FIG. 5*b*) by means of the respective maximum amplitude envelope.

Amplifier 11' receives the demodulated maximum reference signal Vr0', with a frequency of 1/Ft, from the demodulator 11 over a line 13, and over a second line 13' the demodulated measurement signal Vs' of each heater F1–F4, as well as the demodulated minimum reference signal Vr1', with a frequency of ⅙ Ft, since all these have to be extracted sequentially from the reference signal Vr0'.

From the differential amplifier 11', of each 1/Ft pulse train there are obtained sequentially two amplified differential values Vm and Vrr (FIG. 5*b*), which are the differential voltages of the envelopes of the signals of each measurement Vs' and the minimum reference signal Vr1 in respect of the maximum reference signal Vr0', conducted afterwards over a line 18 to a "Vin" input on the microcontroller 4.

From these differential values Vm and Vrr a ratio Mf1–Mf4 of each heater F1–F4 is calculated, such that Mf=Vm/Vrr, i.e. a ratio of the differential measurement value Vm in respect of the differential value Vrr of the two references (Vr0'–Vr1'), thereby preventing the influence of ambient temperature on the result of the subsequent comparison for the switching of actuator 14, 15.

In the example of pan 2 and sensor loop E1–E4 with the afore-mentioned dimensions, on the basis of prior tests with said pan of the most appropriate diameter D and with smaller pans, for instance between 50% and 80% of the most appropriate diameter, we find an individual numerical value R1–R4 of each heater F1–F4 lying between 0.5 and 0.8, with which the above-calculated value Mf1–Mf4 is compared for actuating the power.

What is claimed is:

1. Sensor circuit for the detection of a metal pan on a glass ceramic cooker hob provided with various independent heaters, comprising:

a respective sensor loop extended over the area of each heater, a circuit part for generating a single high-frequency current applied to all the sensor loops by way of at least one supply cable, each loop generating a magnetic field of the same frequency affected by the proximity of a pan on the heater, a microprocessor, which supplies a pulse train to the circuit part for the generation of said frequency of the current, a circuit part for measuring and evaluating the resultant voltage of said current and of said magnetic field at the ends of each sensor loop, depending on the area of the sensor loop covered by the pan on each heater, said circuit for measuring and evaluating comprising a selector circuit which commutes and separates said voltage signals governed by the microprocessor and, a circuit part for the amplification and demodulation of said voltage signals, which compares each demodulated voltage signal with a predetermined reference voltage value relative to an appropriated pan diameter for each heater, a circuit part for regulating the power of each one of the heaters, depending on the result of said comparison of each voltage signal with said reference voltage.

2. The sensor circuit of claim 1, wherein the circuit for generation of said high-frequency current comprises an amplifier and a filter, while the current is supplied by way of a single individual cable to each sensor loop.

3. The sensor circuit of claim 1, wherein said reference signal comes from the generator circuit and is transmitted to the selector circuit for the correction of each measurement of the voltage signals in accordance with the ambient temperature of the sensor circuit.

4. Pan sensor circuit according to claim 1, wherein said reference signals obtained from the inductive circuit are two maximum and minimum signals representative of the impedance of the heaters in the respective conditions of total coverage with a pan and absence of a pan, at a given ambient temperature.

5. Sensor circuit according to claim 1, wherein the means for conversion and amplification of the measuring and reference signals comprise a demodulator of the voltage signals in each pulse train and an amplifier of the differential value between the measurement voltage and a differential value between the two reference voltages.

6. Sensor circuit according to claim 1, wherein each sensor loop is supplied by a single cable and the high-frequency measuring voltage signal of each heater is taken at a point of the free end of the cable in order to prevent cable impedance affecting the measurement.

7. Sensor circuit for detecting a metal pan on a glass ceramic electric cooker hob provided with various independent heaters, comprising a respective sensor loop extended over the area of each heater, a circuit part for generating a single high-frequency current applied to all the sensor loops by way of at least one supply cable, each sensor loop generating a magnetic field of the same frequency affected by the proximity of a pan on the heater, a microprocessor, which supplies a pulse train to the circuit part for the generation of said current frequency, a circuit part for measuring and evaluating the resultant voltage of said current in each sensor loop, in accordance with the area covered by the pan on each heater, a circuit part that comprises a reference inductive circuit from which it generates two reference voltage signals representative of all the heaters relative to the area covered by the pan on each heater, a circuit part for measuring each voltage signal in the sensor loops and said reference voltage signals, including means for the conversion of said signals into low-frequency voltage values, their subsequent differential amplification, and for their comparative evaluation, wherein the microcontroller calculates a numerical ratio of the differential voltage measured in the sensor loop in respect of a differential voltage between both reference voltages, for the corresponding actuation of the electrical power of each heater.

* * * * *